US010672533B2

(12) United States Patent
Verhagen

(10) Patent No.: US 10,672,533 B2
(45) Date of Patent: Jun. 2, 2020

(54) RESILIENT AIR-COOLED INDUCTION HEATING CABLES

(71) Applicant: Illinois Tool Works Inc., Glenview, IL (US)

(72) Inventor: Paul Verhagen, Grand Chute, WI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 16/189,888

(22) Filed: Nov. 13, 2018

(65) Prior Publication Data

US 2019/0148034 A1 May 16, 2019

Related U.S. Application Data

(60) Provisional application No. 62/586,566, filed on Nov. 15, 2017.

(51) Int. Cl.

| | |
|---|---|
| ***H01B 7/00*** | (2006.01) |
| ***H01B 7/18*** | (2006.01) |
| ***H05B 6/02*** | (2006.01) |
| ***H01B 7/42*** | (2006.01) |
| ***H01B 7/29*** | (2006.01) |
| ***H01B 3/46*** | (2006.01) |
| ***H05B 6/10*** | (2006.01) |

(52) U.S. Cl.

CPC ..... *H01B 7/1885* (2013.01); *H01B 3/46* (2013.01); *H01B 7/1865* (2013.01); *H01B 7/292* (2013.01); *H01B 7/423* (2013.01); *H05B 6/02* (2013.01); *H05B 6/101* (2013.01)

(58) Field of Classification Search

CPC ..... H01B 7/02; H01B 7/009; H01B 7/1885; H01B 7/292; H01B 7/423; H01B 7/0225; H01B 7/421

USPC ..... 174/102 R, 104, 106 R, 113 R, 108, 174/117 R, 117 F

See application file for complete search history.

(56) References Cited

U.S. PATENT DOCUMENTS

| | | | | |
|---|---|---|---|---|
| 5,461,215 | A * | 10/1995 | Haldeman | H05B 6/42 174/15.6 |
| 6,211,498 | B1 * | 4/2001 | Patridge | H05B 6/02 219/660 |
| 2003/0038130 | A1 | 2/2003 | Thomas | |
| 2006/0162952 | A1 * | 7/2006 | Olbrich | H02K 3/04 174/128.1 |
| 2017/0011820 | A1 | 1/2017 | Yin | |

FOREIGN PATENT DOCUMENTS

| | | | | |
|---|---|---|---|---|
| DE | 3243061 | | 5/1984 | |
| DE | 3243061 | A1 * | 5/1984 | H01B 7/04 |
| DE | 29805878 | | 5/1998 | |
| EP | 2711938 | | 3/2014 | |
| WO | 2006132935 | | 12/2006 | |

OTHER PUBLICATIONS

Int'l Search Report and Written Opinion Appln No. PCT/US2018/061036 dated Feb. 15, 2019 (15 pgs).

* cited by examiner

*Primary Examiner* — William H. Mayo, III

(74) *Attorney, Agent, or Firm* — McAndrews, Held & Malloy, Ltd.

(57) ABSTRACT

An example cable assembly includes: a plurality of conductors in a Litz cable arrangement; a layer of magnet wire insulation over the Litz cable arrangement; an inner silicone dielectric jacket over the layer of magnet wire insulation; and an outer silicone jacket over the inner silicone dielectric jacket.

13 Claims, 1 Drawing Sheet

RESILIENT AIR-COOLED INDUCTION HEATING CABLES

BACKGROUND

Induction heating of workpieces to be welded, such as pipe, often involves arranging a fixture and/or one or more conductive cables in proximity to the workpiece. Conventional heating conductors may be liquid-cooled or air-cooled. Conventional air-cooled cables are constructed by pulling cables through sleeves, such as a PyroSleeve sleeve, for thermal and mechanical protection. Pulling the cables through sleeves is a difficult and labor intensive process that limits the length of cable jacket installed. Conventional cables are constructed with 150° C. magnet wire insulation, which requires additional thermal protection from the heat of the part being inductively heated, which can reach temperatures in excess of 150° C. (e.g., the temperature rating of the insulation of conventional cables). Cable manufacturers are able to extrude silicone insulation as a jacket, but silicone insulation is soft, cuts and/or tears easily, and does not hold up to abrasion.

There is a need for air-cooled induction heating cables that have enhanced resistance to wear, abrasion, cuts, tears, and heat.

SUMMARY

Resilient air-cooled induction heating cables are disclosed, substantially as illustrated by and described in connection with at least one of the figures, as set forth more completely in the claims.

BRIEF DESCRIPTION OF THE DRAWINGS

The figures are not necessarily to scale. Where appropriate, similar or identical reference numbers are used to refer to similar or identical components.

DETAILED DESCRIPTION

Figure 1:
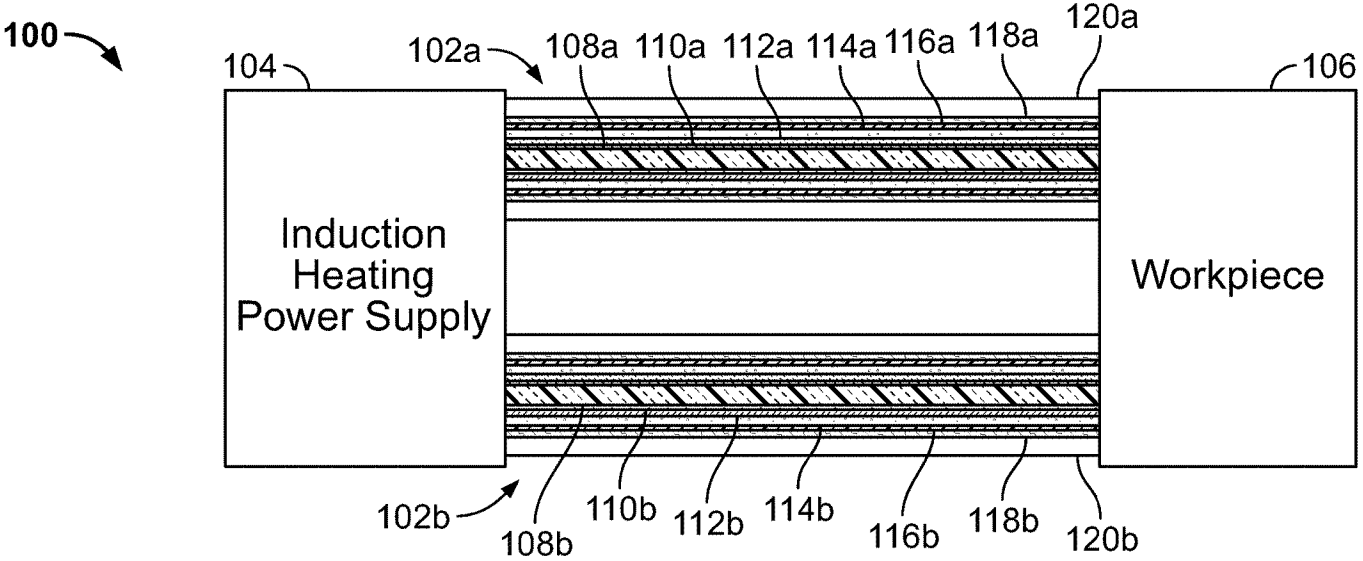
FIG. 1 is a block diagram of an example induction heating system including a cable assembly constructed in accordance with aspects of this disclosure.

Disclosed air-cooled cables address the issues with conventional air-cooled heating cables by having improved abrasion and/or tear resistance and/or higher heat tolerance. Some disclosed examples include 200° C. magnet wire insulation, Polytetrafluoroethylene (PTFE) tape for flexibility, silicone inner jacket for dielectric and flexibility, another layer of PTFE tape for flexibility, fiber braid to prevent tears if outer layer is cut, and finally a more durable silicone outer jacket that withstands abrasion better than normal silicone.

As used herein, referring to a first layer of a cable as "over" a second layer is defined to mean that the first layer is outside of the second layer (i.e., farther from the center). As used herein, referring to a first layer of a cable as "under" a second layer is defined to mean that the first layer is inside of the second layer (i.e., closer to the center). The first layer being over or under the second layer may include zero or more layers between the first or second layers. That is, the first layer being "over" or "under" the second layer does not necessarily mean direct contact between the layers.

Disclosed example cable assemblies include: a plurality of conductors in a Litz cable arrangement; a layer of magnet wire insulation over the Litz cable arrangement; an inner silicone dielectric jacket over the layer of magnet wire insulation; and an outer silicone jacket over the inner silicone dielectric jacket.

In some examples, the outer silicone jacket has a durometer of at least 60. In some examples, the layer of tape includes at least one of Polytetrafluoroethylene, biaxially-oriented polyethylene terephthalate, Polytetrafluoroethylene (PTEF), Fluoroethylkene Polymer (FEP), Polyethersulfone (PES), Polyphenylene sulfide (PPS), nylon, Perfluoroalkoxy alkane (PFA), or Ethylene tetrafluoroethylene (ETFE). Some example cable assemblies further include a layer of tape wrapped over the inner silicone jacket, in which the outer silicone jacket is over the layer of tape. Some example cable assemblies further include a fiber braid over the second layer of tape. In some examples, the layer of tape includes at least one of PTFE, biaxially-oriented polyethylene terephthalate, PTEF, FEP, PES, PPS, PFA, nylon, or ETFE.

Some example cable assemblies further include a fiber braid over the inner silicone dielectric jacket. In some examples, the cable assembly is air-cooled.

Disclosed example induction heating systems include: an induction heating power supply; and a cable assembly configured to deliver power output by the induction heating power supply to a workpiece, the cable assembly includes: a plurality of conductors in a Litz cable arrangement and configured to provide induction heating power from the induction heating power supply to a workpiece; a layer of magnet wire insulation over the Litz cable arrangement; a first layer of tape wrapped over the layer of magnet wire insulation; an inner silicone dielectric jacket extruded over the first layer of tape; a second layer of tape wrapped over the inner silicone jacket; a fiber braid over the second layer of tape; and an outer silicone jacket.

In some examples, the outer silicone jacket has a durometer of at least 60. In some examples, the first layer of tape comprises at least one of PTFE, biaxially-oriented polyethylene terephthalate, PTEF, FEP, PES, PPS, PFA, nylon, or ETFE. In some examples, the second layer of tape comprises at least one of Polytetrafluoroethylene, biaxially-oriented polyethylene terephthalate, PTEF, FEP, PES, PPS, PFA, nylon, ETFE, and/or any other fluoro-poly material.

Figure 2:
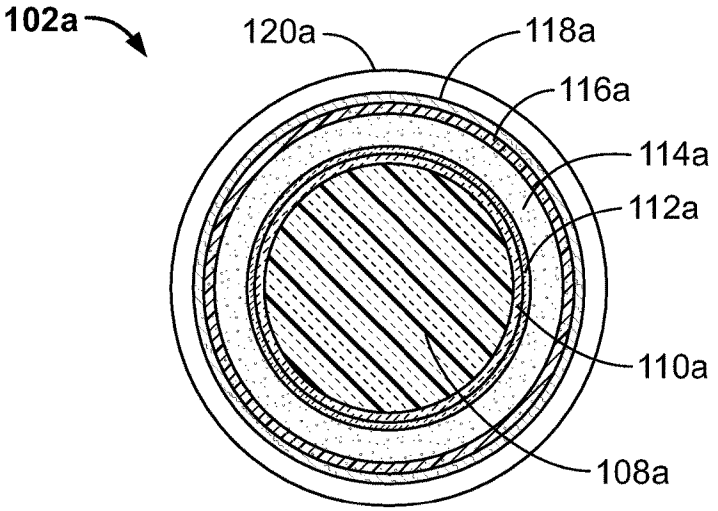
FIG. 2 is an example implementation of the cable assembly of FIG. 1.

FIG. 1 is a block diagram of an example induction heating system 100 including induction heating cables 102*a*, 102*b*. FIG. 2 is a cross-section of an example implementation of the cable 102*a* of FIG. 1. The heating system 100 includes an induction heating power supply 104 that provides heating power to a workpiece 106 via the cables 102*a*, 102*b*.

Each of the example cables 102*a*, 102*b* includes one or more individual conductors 108*a*, 108*b* (or conductive filaments), such as Litz wire. The cables 102*a*, 102*b* may alternatively be non-Litz cables, such as braided conductors. The example cables 102*a*, 102*b* are air-cooled, in that the cables 102*a*, 102*b* are cooled via convection and/or radiation, and do not have internal coolant.

In addition to the insulation around each of the individual conductors or conductive filaments 108*a*, 108*b*, a layer of high temperature (e.g., 200° C. rated) magnet wire insulation 110*a*, 110*b* surrounds the conductors 108*a*, 108*b*. Wrapped around the magnet wire insulation 110*a*, 110*b* is a layer of PTFE 112*a*, 112*b*, which may be in the form of PTFE tape. The PTFE tape 112*a*, 112*b* reduces friction between the magnet wire insulation 110*a*, 110*b* and a silicone inner jacket 114*a*, 114*b* wrapped around the PTFE 112*a*, 112*b*. The presence of the PTFE 112*a*, 112*b* improves a flexibility of the cables 102*a*, 102*b*, compared with omission of the PTFE 112*a*, 112*b* with a direct interface between the magnet wire insulation 110*a*, 110*b* and the silicone inner jacket 114*a*, 114*b*.

The silicone inner jacket 114*a*, 114*b* is a dielectric and also contributes to flexibility of the cable 102*a*, 102*b*. The silicone inner jacket 114*a*, 11*b* is wrapped in a second layer of PTFE 116*a*, 116*b*. Either or both of the layers of PTFE 112*a*, 112*b*, 116*a*, 116*b* may be replaced with other materials, such as PTFE, biaxially-oriented polyethylene terephthalate, PTEF, FEP, PES, PPS, PFA, nylon, or ETFE.

A fiber braid 118*a*, 118*b* is placed around the PTFE 116*a*, 116*b*, and a durable silicone outer jacket 120*a*, 120*b* is an outermost layer of the example cables 102*a*, 102*b*. The fiber braid reduces or prevents tears in the cable 102*a*, 102*b* in the event that the outer jacket 120*a*, 120*b* is cut. The outer jacket 120*a*, 120*b* is constructed using a silicone formula that withstands abrasion and has a high durometer value (e.g., a durometer of 60 or more). In some other examples, the outer jacket 120*a*, 120*b* may be constructed using a woven or braided sleeving, constructed using fiberglass or silica, with a silicone coating on the outside for abrasion resistance. An example material that may be used for the outer jacket 120*a*, 120*b* is a PyroSleeve sleeving material, which may be wrapped, woven, and/or extruded over the rest of the cable 102*a*, 102*b*. In the example of FIG. 1, the outer jacket 120*a*, 120*b* has a durometer of at least 60.

In some examples, the inner jacket 114*a*, 114*b* and/or the outer jacket 120*a*, 120*b* are constructed of vulcanized rubber instead of silicone.

In some examples, one or both layers of PTFE 112*a*, 112*b*, 116*a*, 116*b* may be omitted or replaced with another material. Omission of one or both layers of PTFE 112*a*, 112*b*, 116*a*, 116*b* may result in a stiffer cable 102*a*, 102*b*. In some examples, the fiber braid 118*a*, 118*b* may be omitted. However, omission of the fiber braid 118*a*, 118*b* may reduce the resistance of the cables 102*a*, 102*b* to tearing.

While example layers 108*a*-120*a*, 108*b*-120*b* are described with reference to FIGS. 1 and 2, additional layers may also be included. However, more layers may reduce coupling between the cable 102*a*, 102*b* and the workpiece 106.

Relative to conventional air-cooled heating cables, the example cables 102*a*, 102*b* are more resilient against abuse than cables typically experience on a work site (e.g., dragging of the cables 102*a*, 102*b*), are more heat tolerant, provide improved magnetic coupling with a workpiece, are more flexible (e.g., are able to wrap around smaller-diameter workpieces), and/or are capable of manufacturing in longer lengths.

As utilized herein, "and/or" means any one or more of the items in the list joined by "and/or". As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z". As utilized herein, the term "exemplary" means serving as a non-limiting example, instance, or illustration. As utilized herein, the terms "e.g.," and "for example" set off lists of one or more non-limiting examples, instances, or illustrations.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. For example, blocks and/or components of disclosed examples may be combined, divided, re-arranged, and/or otherwise modified. Therefore, it is intended that the present method and/or system not be limited to the particular implementations disclosed, but that the present method and/or system will include all implementations falling within the scope of the appended claims, both literally and under the doctrine of equivalents.

What is claimed is:

1. A cable assembly, comprising:

a plurality of conductors in a Litz cable arrangement, in which each of the plurality of conductors is electrically insulated from each other over at least a portion of a length of the Litz cable arrangement;

a layer of magnet wire insulation over the Litz cable arrangement;

an inner silicone dielectric jacket over the layer of magnet wire insulation; and an outer silicone jacket over the inner silicone dielectric jacket.

2. The cable assembly as defined in claim 1, wherein the outer silicone jacket has a durometer of at least 60.

3. The cable assembly as defined in claim 1, further comprising a layer of tape wrapped over the layer of magnet wire insulation, the inner silicone dielectric jacket being extruded over the layer of tape.

4. The cable assembly as defined in claim 3, wherein the layer of tape comprises at least one of Polytetrafluoroethylene or biaxially-oriented polyethylene terephthalate.

5. The cable assembly as defined in claim 1, further comprising a layer of tape wrapped over the inner silicone jacket, wherein the outer silicone jacket is over the layer of tape.

6. The cable assembly as defined in claim 5, further comprising a fiber braid over the second layer of tape.

7. The cable assembly as defined in claim 5, wherein the layer of tape comprises at least one of Polytetrafluoroethylene or biaxially-oriented polyethylene terephthalate.

8. The cable assembly as defined in claim 1, further comprising a fiber braid over the inner silicone dielectric jacket.

9. The cable assembly as defined in claim 1, wherein the cable assembly is air-cooled.

10. An induction heating system, comprising:

an induction heating power supply; and a cable assembly configured to deliver power output by the induction heating power supply to a workpiece, the cable assembly comprising:

a plurality of conductors in a Litz cable arrangement and configured to provide induction heating power from the induction heating power supply to a workpiece;

a layer of magnet wire insulation over the Litz cable arrangement;

a first layer of tape wrapped over the layer of magnet wire insulation;

an inner silicone dielectric jacket extruded over the first layer of tape;

a second layer of tape wrapped over the inner silicone jacket;

a fiber braid over the second layer of tape; and an outer silicone jacket.

11. The system as defined in claim 10, wherein the outer silicone jacket has a durometer of at least 60.

12. The cable assembly as defined in claim 10, wherein the first layer of tape comprises at least one of Polytetrafluoroethylene or biaxially-oriented polyethylene terephthalate.

13. The cable assembly as defined in claim 10, wherein the second layer of tape comprises at least one of Polytetrafluoroethylene or biaxially-oriented polyethylene terephthalate.

* * * * *